US009557062B2

(12) United States Patent
Maurer et al.

(10) Patent No.: US 9,557,062 B2
(45) Date of Patent: Jan. 31, 2017

(54) DAMPING DEVICE FOR A GAS TURBINE COMBUSTOR

(71) Applicant: ALSTOM Technology Ltd, Baden (CH)

(72) Inventors: Thomas Michael Maurer, Bad Säckingen (DE); Urs Benz, Gipf-Oberfrick (CH); Mirko Ruben Bothien, Zürich (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 477 days.

(21) Appl. No.: 14/088,527

(22) Filed: Nov. 25, 2013

(65) Prior Publication Data

US 2014/0150435 A1 Jun. 5, 2014

(30) Foreign Application Priority Data

Nov. 30, 2012 (EP) ..... 12195066

(51) Int. Cl.
*F23R 3/00* (2006.01)
*F23R 3/42* (2006.01)
*F23M 20/00* (2014.01)

(52) U.S. Cl.
CPC ..... *F23R 3/42* (2013.01); *F23M 20/005* (2015.01); *F23R 3/00* (2013.01); *F23R 3/002* (2013.01); *F05D 2260/963* (2013.01); *F23R 2900/00014* (2013.01)

(58) Field of Classification Search
CPC ..... F23R 2900/00014; F23R 3/00; F23R 3/42; F23M 20/005; F05D 2260/963
See application file for complete search history.

(56) References Cited

U.S. PATENT DOCUMENTS

2005/0034918 A1 2/2005 Bland et al.
2005/0229581 A1 10/2005 Bellucci et al.
2007/0034447 A1* 2/2007 Proscia ..... F01D 25/30 181/290

(Continued)

FOREIGN PATENT DOCUMENTS

EP 2 295 864 3/2011
EP 2 362 147 8/2011

(Continued)

*Primary Examiner* — Gerald L Sung
*Assistant Examiner* — William Breazeal
(74) *Attorney, Agent, or Firm* — Buchanan Ingersoll & Rooney PC

(57) ABSTRACT

The invention relates to a damping device for a gas turbine combustor with significantly reduced cooling air mass flow requirements. The damping device includes a wall with a first inner wall and a second outer wall, arranged in a distance to each other. The inner wall is subjected to high temperatures on a side with a hot gas flow. A plurality of cooling channels extend essentially parallel between the first inner wall and the second outer wall, and at least one damping volume bordered by cooling channels. Furthermore, the damping device includes a first passage for supplying a cooling medium from a cooling channel into the damping volume and a second passage for connecting the damping volume to the combustion chamber. An end plate, fixed to the inner wall, separates the damping volume from the combustion chamber.

15 Claims, 2 Drawing Sheets

(56) References Cited

U.S. PATENT DOCUMENTS

| | | | | |
|---|---|---|---|---|
| 2007/0283700 | A1* | 12/2007 | Gerendas | F23R 3/002 60/754 |
| 2011/0265484 | A1* | 11/2011 | Huber | F23M 99/005 60/755 |
| 2012/0006028 | A1 | 1/2012 | Lee et al. | |
| 2012/0102963 | A1 | 5/2012 | Corr et al. | |
| 2013/0098063 | A1* | 4/2013 | Mizukami | F01D 9/023 60/785 |

FOREIGN PATENT DOCUMENTS

| | | | |
|---|---|---|---|
| EP | 2 402 658 | | 1/2012 |
| JP | 2004-509313 | | 3/2004 |
| RU | 2219439 | C1 | 12/2003 |
| RU | 2380618 | C2 | 1/2010 |
| WO | 02/25174 | | 3/2002 |

* cited by examiner

DAMPING DEVICE FOR A GAS TURBINE COMBUSTOR

CROSS-REFERENCE TO RELATED APPLICATIONS

This application claims priority to European application 12195066.1 filed Nov. 30, 2012, the contents of which are hereby incorporated in its entirety.

TECHNICAL FIELD

The present invention relates to the field of gas turbines, in particular to lean premixed, low emission combustion systems having one or more devices to suppress thermo-acoustically induced pressure oscillations in the high frequency range, which have to be properly cooled to ensure a well-defined damping performance and a sufficient lifetime.

BACKGROUND

A drawback of lean premixed, low emission combustion systems in gas turbines is that they exhibit an increased risk in generating thermo-acoustically induced combustion oscillations. Such oscillations, which have been a well-known problem since the early days of gas turbine development, are due to the strong coupling between fluctuations of heat release rate and pressure and can cause mechanical and thermal damages and limit the operating regime.

A possibility to suppress such oscillations consists in attaching damping devices, such as quarter wave tubes, Helmholtz dampers or acoustic screens.

A reheat combustion system for a gas turbine with sequential combustion including an acoustic screen is described in the document US 2005/229581 A1. The acoustic screen, which is provided inside the mixing zone and/or the combustion chamber, consists of two perforated walls. The volume between both can be seen as multiple integrated Helmholtz volumes. The backward perforated plate allows an impingement cooling of the plate facing the hot combustion chamber.

To prevent hot gases to enter from the combustion chamber into the damping volume, an impingement cooling mass flow is required, which decreases the damping efficiency. If the impingement mass flow is too small, the hot gases recirculate passing through the adjacent holes of the acoustic screen. This phenomenon is known as hot gas ingestion. In case of hot gas ingestion the temperature rises in the damping volume. This leads to an increase of the speed of sound and finally to a shift of the frequency, for which the damping system has been designed. The frequency shift can lead to a strong decrease in damping efficiency. In addition, as the hot gas recirculates in the damping volume, the cooling efficiency is decreased, which can lead to thermal damage of the damping device. Moreover, using a high cooling mass flow, increases the amount of air, which does not take part in the combustion. This results in a higher firing temperature and thus leads to an increase of the NOx emissions.

A solution to the mentioned issues is described, for example, in the document EP 2295864. Here, a multitude of layers are braced together to form single compact Helmholtz dampers, which are cooled using an internal near-wall cooling technique close to the hot combustion chamber. Therefore, the cooling mass flow can be drastically reduced without facing the problem of hot gas ingestion, leading to less emissions and a higher damping efficiency. As single Helmholtz dampers are used, different frequencies can be addressed separately. Whether single or a cluster of Helmholtz dampers is used, the design is based on an appropriate implementation of a near wall cooling.

Another solution of a high-frequency damping system for a combustor in a gas turbine with a cooled wall part is disclosed in EP 2402658. A plurality of cooling paths extending in axial direction are formed in the combustor wall. The cooling paths are connected to a source of cooling medium, such as steam or cooling air, at the one end and to a cooling medium discharge channel at the other end. The cooling medium flowing through the cooling paths cools the peripheral portions of the through holes to avoid or minimize thermal stress, caused by the hot combustion gases when passing the through holes in case of hot gas ingestion.

The document EP 2362147 describes various solutions on how the near-wall cooling can be realized. The near-wall cooling passages are either straight passages or show coil shaped structures parallel to the laminated plates. A drawback of this solution is that due to the shape of the near wall cooling channels, the component is to be made from several layers, which in the end have to be brazed together. Brazing itself is a well-known technique in the turbo machinery business, but inherits disadvantages while compared to other joining methods.

Another way to realize different shapes of near wall cooling channels in wall structures would be to use a so-called "lost wax casting process". With this technique, which is widely used to manufacture cooling passages in turbine blades, a ceramic core is used during the casting process to realize the later cooling channels. Compared to casting processes that can avoid the usage of ceramic cores, the production costs are multiple times higher.

SUMMARY

It is an object of the present invention is to provide a near wall cooling system for a damping device of a gas turbine combustor with significantly reduced cooling air mass flow requirements, which eliminates the drawbacks of expensive casting techniques.

This object is obtained by a damping device for a gas turbine combustor according to claim 1.

The damping device for a gas turbine combustor, which is especially a damping device for a liner segment with a near wall cooling system, comprises a wall with a first inner wall, particularly the liner, and a second outer wall, arranged in a distance to each other, wherein said inner wall is subjected to high temperatures on a side with a hot gas flow, a plurality of cooling channels extending essentially parallel between the first inner wall and the second outer wall, and at least one damping volume bordered by said cooling channels, a first passage for supplying a cooling medium from a cooling channel into the damping volume and a second passage for connecting the damping volume to the combustion chamber, wherein an end plate is fixed to the inner wall, separating the damping volume from the combustion chamber, said end plate is provided with the neck passage and is additionally provided with at least one feed plenum for a cooling medium, at least one exit plenum for a cooling medium and at least one cooling passage enabling a flow of cooling medium from the at least one feed plenum to another feed plenum or to the at least one exit plenum.

The cooling passages between said plena act as near wall cooling channels.

According to a preferred embodiment the lateral edges of the end plate are provided with recesses. When connected to the inner wall, these recesses form the feed and exit plena.

The new invention enables an optimized cooling and lifetime performance of high frequency damping systems with reduced cooling air mass flow requirements. The described manufacturing process uses machining and welding techniques and, therefore, eliminates the said drawbacks of brazing and/or expensive casting techniques using ceramic cores. The novel near wall cooling design enables an efficient damping and reduces the manufacturing risks.

Usually, high-frequency dampers in can combustion systems are mounted around the circumference of the can liner with a limited extent in axial direction. If a near-wall cooling damper scheme is mounted in this way, difficulties in the manufacturing process arise because the bending process might influence the cooling channel geometries and thus cause a non-uniform cooling distribution. By arranging the near-wall damper volumes in axial direction these difficulties are overcome.

BRIEF DESCRIPTION OF THE DRAWINGS

The present invention is now to be explained more closely by means of different embodiments and with reference to the drawings.

DETAILED DESCRIPTION

Figure 1:
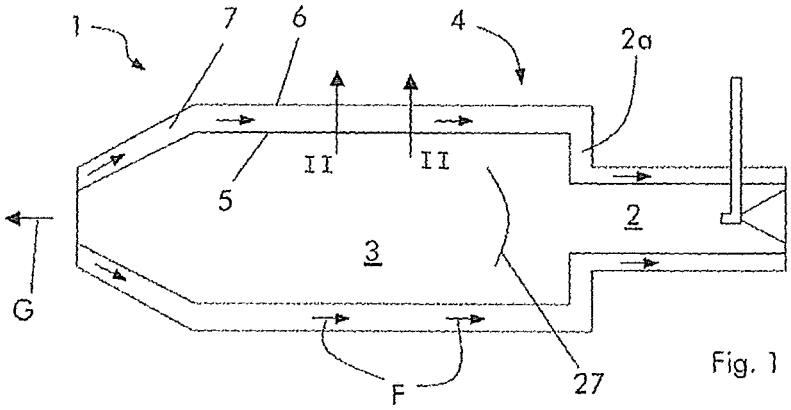
FIG. 1 shows a schematic view of a reheat combustor of a gas turbine.

FIG. 1 shows a reheat combustor 1 of a gas turbine with sequential combustion according to the state of the art. The combustor 1 comprises a burner section 2, axially connected to a combustion chamber 3. The hot gas flow entering the burner section 2 is fed with fuel by means of fuel supply injectors (e.g. fuel lances), extending into the hot gas flow, and then flowing along a mixing zone. The mixture, formed in the mixing zone, leaves the burner section 2 at its exit to expand into the combustion chamber 3. In the combustion chamber 3 the mixture is combusted in a flame 27, generating hot gases G that are expanded in a turbine (not shown).

The interface between the burner section 2 and the combustion chamber 3 is characterized by a regularly sudden cross-sectional area change comprising a perpendicular front plate 2*a*, extending from the exit of the burner section 2 to the peripheral wall of the combustion chamber 3. At least a portion 4 of the combustor walls, including the burner section 2 and/or the combustion chamber 3 and/or the front plate 2*a*, are equipped with cooling means. For example, the combustor walls as a whole or any portions of the burner section 2 and/or the combustion chamber 3 and/or the front plate 2*a* comprise an inner liner 5 and, in a distance thereof, an outer cover plate 6, inner liner 5 and outer cover plate 6 defining an interposed cooling chamber. A cooling medium, such as air or steam, circulates through cooling channels 7 in this cooling chamber (as indicated by arrows F), thereby cooling the burner section 2, the combustion chamber 3 and the front plate 2*a*.

Figure 2:
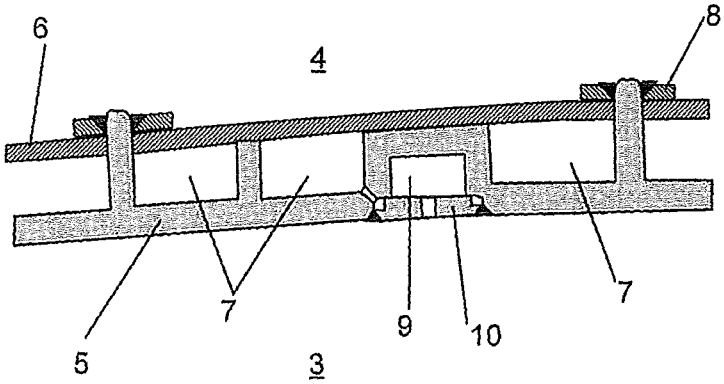
FIG. 2 shows a cross-section of the combustion chamber wall.

FIG. 2 is a cross section of the combustion chamber wall, showing the liner 5 and the cover plate 6, which define the channels 7 for the cooling medium. The cover plate 6 is joined with the liner 5 by using fixation clips 8, which are welded onto pins that extend from the liner surface. Webs on the outer side of the liner 5 act as sidewalls of the cooling channels 7 and support the wall structure 5,6. In the distance between inner liner 5 and cover plate 6 the acoustic damping devices are located. The damping volume 9 is bordered by the cooling channels 7. Towards the combustion chamber 3 the damping volume 9 is separated by an end plate 10, as described below.

The advantage of this design is that the outer shape of the acoustic damper can be incorporated in the casting process of the liner 5. To define the needed acoustic volume 9 and to close the damping device, a machined end plate 10 is welded onto the liner 5 covering the molded-in recess. The end plate 10 is equipped with at least one through-hole 13, the neck passage for the interaction between the combustion chamber 3 and the damping volume 9.

Figure 3:
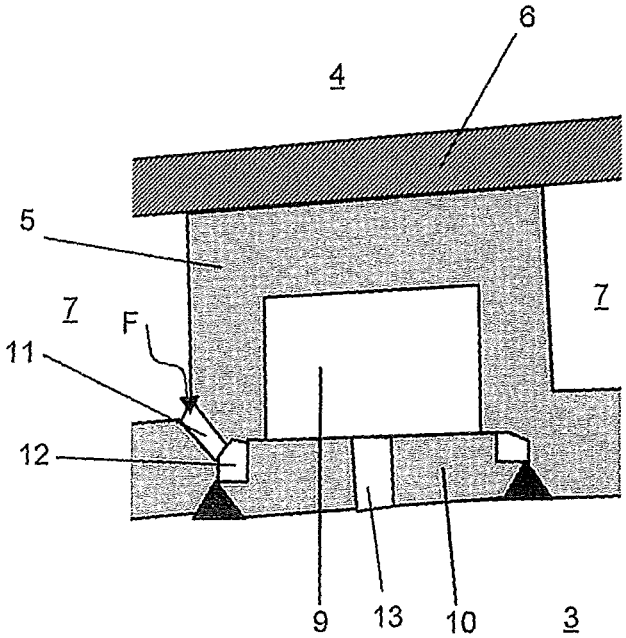
FIG. 3 shows an enlarged view of the damping device according to the invention.

FIG. 3 illustrates in an enlarged picture the principle structure of a damping device according to the present invention. The liner components 5 of the combustor 1 are regularly manufactured by casting. In the process of casting a number of recesses 9 is molded in the liner 5. In a following step these recesses 9 are covered by welding an end plate 10 on every recess 9. The volume, bounded by the recessed liner 5 and the end plate 10, forms the damping volume 9 of the damping device. At least one acoustic neck passage 13 is incorporated into the end plate 10 which connects the combustion chamber 3 with the acoustic damper volume 9.

The outer portions of the recessed liner 5 are charged with the cooling medium F, flowing through the cooling channels 7 and therefore are properly cooled. But as the damping device mainly consists of a damping volume 9, which has little or no purge air supply from the cooling circuit 7, the wall temperatures between the damping volume 9 and the combustion chamber 3 would outrun the material limits. As a consequence, an additional cooling means has to be incorporated in the end plate 10. One alternative for cooling this component is a near-wall cooling means.

To realize a near-wall cooling solution for a damping device according to the invention, a first passage 11 is established in liner 5. This passage 11 is connected to a cooling channel 7 at one end. And at the other end this passage 11 is connected to a first feed plenum 12 so that the cooling medium F can flow through passage 11 and supply cooling medium F from the cooling channel 7 into this plenum 12. This first plenum 12 is disposed between the liner 5 and the end plate 10. According to a preferred embodiment the plenum 12 is located in the end plate 10. In the region of its lateral edges a recess is milled into the end plate 10. When connected to the liner 5, these recesses form plenum 12. And this plenum 12 is the starting point of the near wall cooling system of the inventive damping device.

Figure 4:
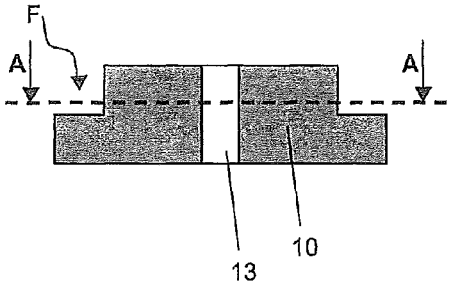
FIG. 4-6 show in more detail embodiments of an end plate for a damping device according to the invention.
Figure 5:
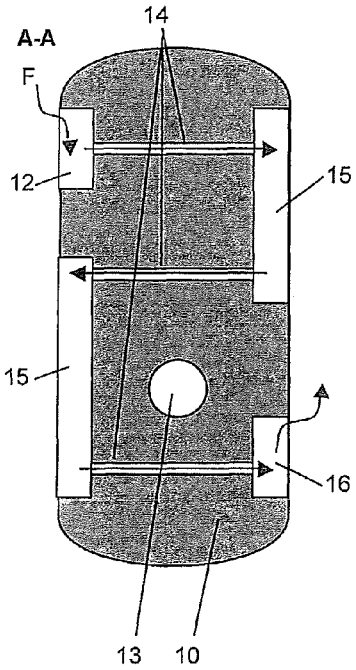
Figure 6:
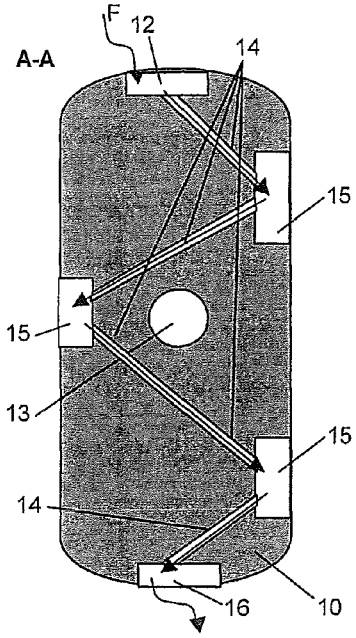

FIGS. 4, 5 and 6 show in more detail different embodiments of the design of the end plate 10.

As can be seen from FIG. 5, the cooling supply stream F enters the near-wall cooling device through the first feed plenum 12. From this first feed plenum 12 a second passage 14 leads the cooling air into a second feed plenum 15. This principle is repeated until the second passage 14 reaches the exit plenum 16. At this position the cooling supply stream F exits the end plate 10 either into the acoustic volume 9 to provide some purge of damping device or the cooling supply stream F leaves the end plate 10 into the combustion chamber 3.

As can be observed from FIG. 6, alternative ways to route the cooling supply stream F through the end plate 10 are feasible. The common idea is to have straight second passages that connect the various feed and exit plena (12, 15 and 16).

The small cooling mass flow (due to the high pressure drop over the near-wall cooling device) is used efficiently to pick up the heat load from the combustion chamber 3. As the design of the near-wall cooling device covers the end plate 10 completely, the wall temperature distribution is homogeneous. A homogenous temperature distribution reduces the thermal stresses and increases the lifetime.

It is an advantage of this structure that all feed plena and passages of the near-wall cooling device can be made by drilling, laser cut, water jet, milling and so on. Up to date, the realization of such a cooling technique requires expensive casting processes (including ceramic cores) or brazing techniques, which are difficult to handle. The advantage of the current invention is that it uses only machining and welding techniques.

The invention claimed is:

1. A damping device for a gas turbine combustor, comprising:

a first inner wall on a side with a hot gas flow and arranged to be subjected to high temperatures;

a second outer wall, arranged at a distance from the first inner wall;

a plurality of cooling channels extending parallel between the first inner wall and the second outer wall;

at least one damping volume between the inner wall and the outer wall;

a first passage for supplying a cooling medium from a cooling channel of the plurality of cooling channels into the damping volume;

a neck passage configured to connect the at least one damping volume to a combustion chamber; and an end plate fixed to the first inner wall, separating the damping volume from the combustion chamber, wherein said end plate is provided with the neck passage and includes at least one feed plenum for the cooling medium, at least one exit plenum for the cooling medium and cooling passages enabling a flow of cooling medium from the at least one feed plenum to a second plenum and to the at least one exit plenum in a cooling medium flow path direction, wherein the feed plenum, exit plenum, second plenum, and the cooling passages are formed within the end plate and are in serial flow communication to circulate cooling medium through the end plate, and the exit plenum exhaust cooling medium to the damping volume or combustion chamber.

2. The damping device according to claim 1, wherein the cooling passages acts as a near wall cooling channel.

3. The damping device according to claim 2, wherein the end plate comprises a plurality of near wall cooling channels.

4. The damping device according to claim 3, wherein the near wall cooling channels have the same cross-section.

5. The damping device according to claim 1, wherein the at least one feed plenum communicates via a feeding passage in the first inner wall with a cooling channel.

6. The damping device according to claim 1, wherein the feed plenum and the second plenum are arranged at different lateral edges of the end plate, and the second plenum and a third plenum are arranged at different lateral edges of the end plate.

7. The damping device according to claim 1, wherein the feed plenum and the second plenum are arranged at opposite edges of the end plate, and the second plenum and a third plenum are arranged at opposite edges of the end plate.

8. The damping device according to claim 7, wherein the cooling passages run parallel.

9. The damping device according to claim 1, wherein the at least one exit plenum communicates with either the damping volume or the combustion chamber.

10. The damping device according to claim 1, wherein lateral edges of the end plate are provided with recesses, and in conjunction with a connected inner wall form the feed plenum and the second plenum.

11. The damping device according to claim 1, wherein the end plate is fixed to the inner wall by welding.

12. The damping device according to claim 1, wherein the inner wall is a liner of a gas turbine combustor.

13. The damping device according to claim 1, wherein the wall comprises more than one individual damping volumes.

14. The damping device according to claim 13, wherein the more than one individual damping volumes are arranged in an axial direction.

15. The damping device according to claim 13, wherein the individual damping volumes have different parameters.

* * * * *